US010222159B1

(12) United States Patent
Carr

(10) Patent No.: US 10,222,159 B1
(45) Date of Patent: Mar. 5, 2019

(54) FIREARM SAFETY

(71) Applicant: STI Firearms, LLC, Georgetown, TX (US)

(72) Inventor: Jesse Carr, Fremont, NH (US)

(73) Assignee: STI Firearms, LLC, Georgetown, TX (US)

( * ) Notice: Subject to any disclaimer, the term of this patent is extended or adjusted under 35 U.S.C. 154(b) by 0 days.

(21) Appl. No.: 15/872,539

(22) Filed: Jan. 16, 2018

Related U.S. Application Data

(60) Provisional application No. 62/445,970, filed on Jan. 13, 2017.

(51) Int. Cl.
*F41A 17/46* (2006.01)

(52) U.S. Cl.
CPC ..... *F41A 17/46* (2013.01)

(58) Field of Classification Search
CPC ..... F41A 19/10; F41A 17/46; F41A 17/48
USPC ..... 42/70.01, 70.11, 70.06, 70.07
See application file for complete search history.

(56) References Cited

U.S. PATENT DOCUMENTS

| | | | | |
|---|---|---|---|---|
| 6,223,460 | B1 | 5/2001 | Schmitter et al. | |
| 6,405,468 | B1 * | 6/2002 | Gilgenbach | F41A 17/22 42/70.01 |
| 6,615,529 | B1 | 9/2003 | Seecamp | |
| 2007/0039223 | A1 | 2/2007 | Werner | |
| 2017/0299305 | A1 | 10/2017 | Bubits | |

FOREIGN PATENT DOCUMENTS

| | | | |
|---|---|---|---|
| WO | WO2000065294 | A1 | 11/2000 |

* cited by examiner

*Primary Examiner* — Reginald S Tillman, Jr.
(74) *Attorney, Agent, or Firm* — Fish & Richardson P.C.

(57) ABSTRACT

In one general aspect, the subject matter described in this specification can be embodied in a firearm safety device including a trigger, a pin, and a safety deactuation device. The trigger has a channel therein with an opening at an end of the channel. The pin is disposed within the channel such that a portion of the pin extends through the opening. The safety deactuation device is configured to engage with the pin and move the pin within the channel of the trigger as the safety deactuation device is moved relative to the trigger.

18 Claims, 6 Drawing Sheets

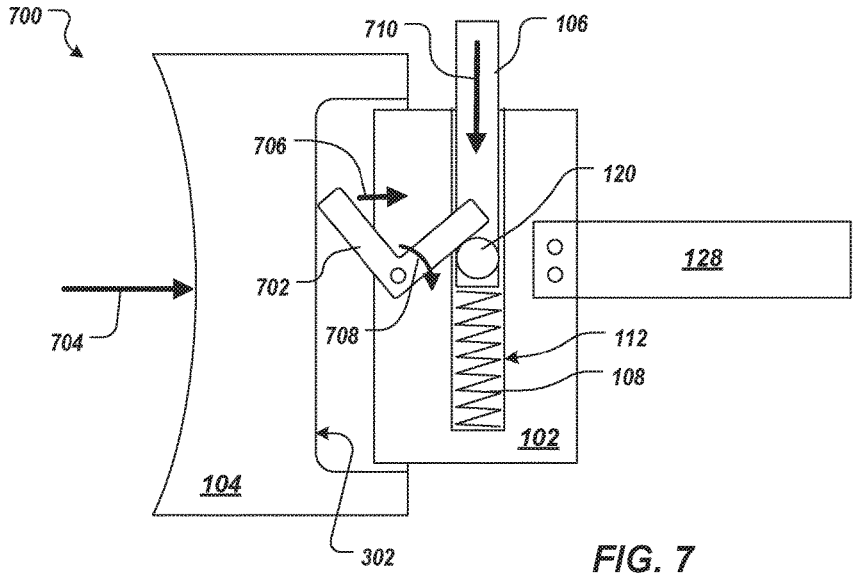
FIG. 7
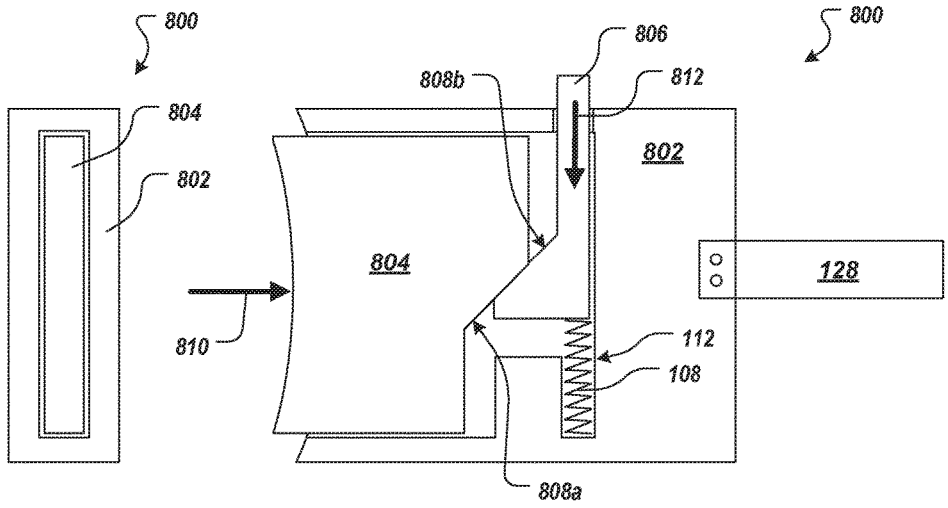
FIG. 8B
FIG. 8A

FIREARM SAFETY

CROSS-REFERENCE TO RELATED APPLICATION

This application claims priority to U.S. Application Ser. No. 62/445,970, filed on Jan. 13, 2017, the entire contents of which is incorporated herein by reference in its entirety.

TECHNICAL FIELD

This invention relates to safety mechanism for a firearm.

BACKGROUND

Firearms often include safety mechanisms to help prevent the accidental discharge of the firearm. Safety mechanisms include external safeties and internal safeties. Some examples of external safeties include manual lever safeties, grip safeties, integrated trigger safeties, and decocker mechanisms. Examples of internal safeties include drop safeties, transfer bars (e.g., in revolvers), impact safeties, and magazine safeties.

SUMMARY

In a first general aspect, the subject matter described in this specification can be embodied in a firearm safety device including a trigger, a pin, and a safety deactuation device. The trigger has a channel therein with an opening at an end of the channel. The pin is disposed within the channel such that a portion of the pin extends through the opening. The safety deactuation device is configured to engage with the pin and move the pin within the channel of the trigger as the safety deactuation device is moved relative to the trigger. In some implementations, the pin is sized such that the portion of the pin can extend through the opening to engage with a hole in a firearm frame.

In a second general aspect, the subject matter described in this specification can be embodied in a firearm that includes a frame and a trigger assembly. The trigger assembly is installed within the frame and includes a trigger, a pin, and a safety deactuation device. The trigger has a channel therein with an opening at an end of the channel. The pin is disposed within the channel such that a portion of the pin extends through the opening and into a hole in the frame, when the pin is in a first position. The safety deactuation device is configured to engage with the pin and move the pin into a second position within the channel of the trigger as the safety deactuation device is moved relative to the trigger.

These and other implementations can each optionally include one or more of the following features.

In some implementations, the safety deactuation device includes a cover at least partially enclosing the trigger and configured to move relative to the trigger.

In some implementations, the cover includes a cam channel configured to engage with the pin and move the pin within the channel of the trigger as the cover moves relative to the trigger.

In a third general aspect, the subject matter described in this specification can be embodied in a firearm safety device including a trigger that has a channel therein with an opening at an end of the channel. A pin is disposed within the channel such that a portion of the pin extends through the opening. A cover at least partially encloses the trigger and is configured to move relative to the trigger. The cover includes a cam channel configured to engage with the pin and move the pin within the channel of the trigger as the cover moves relative to the trigger. In some implementations, the pin is sized such that the portion of the pin can extend through the opening to engage with a hole in a firearm frame.

In a fourth general aspect, the subject matter described in this specification can be embodied in a firearm that includes a frame and a trigger assembly. The trigger assembly is installed within the frame and includes a trigger, a pin, and a cover. The trigger has a channel therein with an opening at an end of the channel. The pin is disposed within the channel such that a portion of the pin extends through the opening and into a hole in the frame, when the pin is in a first position. The cover at least partially encloses the trigger and is configured to move relative to the trigger. The cover includes a cam channel configured to engage with the pin and move the pin into a second position within the channel of the trigger as the cover moves relative to the trigger.

These and other implementations can each optionally include one or more of the following features.

In some implementations, when the pin is in the first position, the pin prevents the trigger from moving. In some implementations, when the pin is in the second position, the trigger is free to move.

In some implementations, a spring is disposed within the channel of the trigger.

In some implementations, the pin is "T" shaped.

In some implementations, the pin includes at least one post extending substantially perpendicular to an axis of the pin, the post configured to engage the cam channel in the cover.

In some implementations, the trigger is a straight-pull trigger.

In some implementations, a trigger bar is coupled to the trigger.

In some implementations, an angle between the cam channel and an axis of the channel in the trigger is more than 10 and less than 90 degrees. In some implementations, an angle between the cam channel and an axis of the channel in the trigger is between 35 and 55 degrees. In some implementations, an angle between the cam channel and an axis of the channel in the trigger is between 40 and 50 degrees. In some implementations, an angle between the cam channel and an axis of the channel in the trigger is approximately 45 degrees.

Particular implementations of the subject matter described in this specification can be implemented so as to realize one or more of the following advantages. Implementations may provide a trigger safety in which the motion of the safety is maintained in line with trigger travel for linear triggers, so that user perception between safety and trigger motion is un-altered during the trigger pull. Implementations may provide trigger safety in which the operation of the safety is imperceptible to the user. Implementations may provide a trigger safety with the feel of a two-stage trigger. Implementations may include fewer parts than existing trigger safety devices.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

FIG. 7 depicts a cutaway view of another implementation of a trigger assembly and safety mechanism according to the present disclosure.

FIG. 8A depicts a cutaway view of another implementation of a trigger assembly and safety mechanism according to the present disclosure.

FIG. 8B depicts a front view of the trigger assembly and safety mechanism of FIG. 8A.

Like reference symbols in the various drawings indicate like elements.

DETAILED DESCRIPTION

The present disclosure generally relates to a safety mechanism for a firearm. More specifically, implementations of the present disclosure relate to a safety mechanism that is integrated into a firearm trigger. For example, implementations of trigger safety mechanism include a trigger with a safety pin disposed within a channel of the trigger. The safety pin engages with a feature in a firearm frame to prevent unintended movement of the trigger and inadvertent discharge of the firearm. The trigger safety mechanism includes a safety deactuation device that engages with the pin to move the pin when the deactuation device is moved relative to the trigger. For example, the safety deactuation device can be configured such that motion between the safety deactuation device and the trigger causes the safety deactuation device to disengage the pin from the firearm frame. Once the pin is disengaged from the frame the safety deactuation device and trigger move together to actuate the firearm's firing mechanism to discharge the firearm.

For simplicity, implementations of the present disclosure are described in reference to a semiautomatic handgun, however, one skilled in the art would appreciate that one or more of the implementations described below may be incorporated into other types of firearms, stun guns, pepper spray, grenade/canister launchers, or other similar devices.

Figure 1:
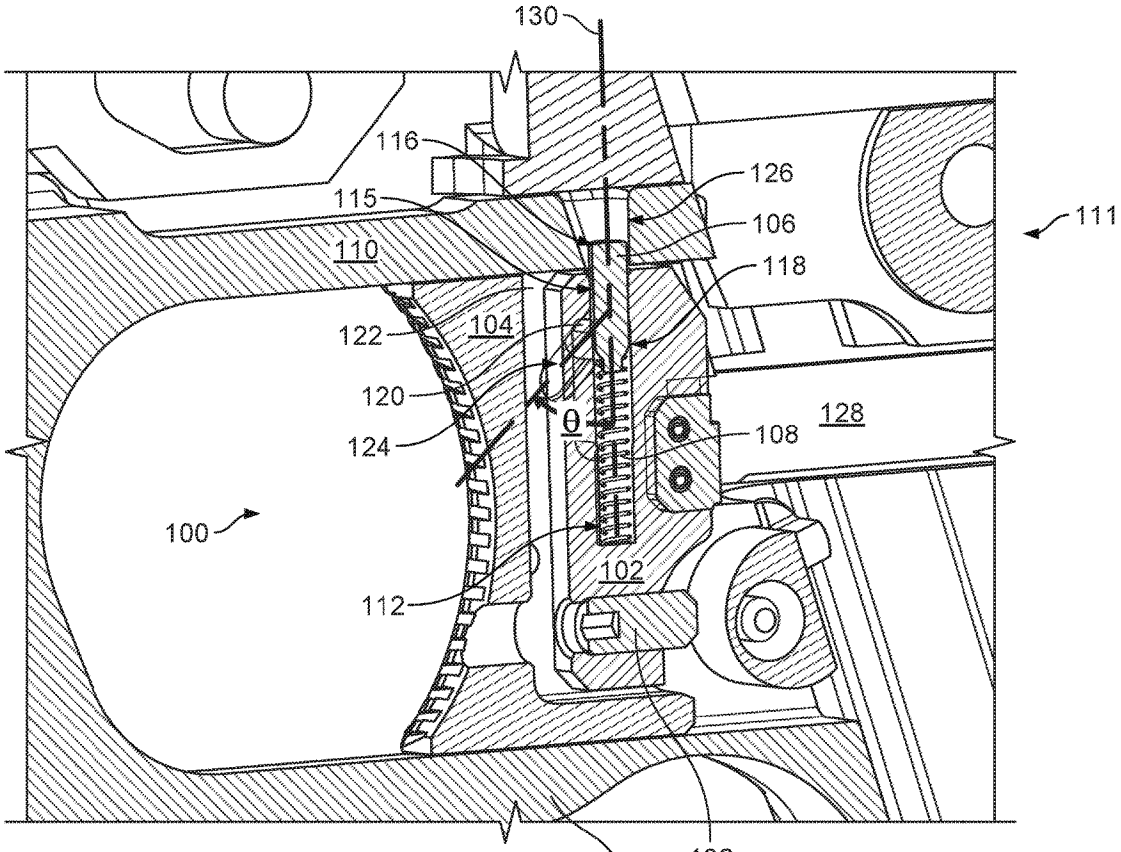
FIG. 1 depicts a cutaway view of an example trigger assembly and safety mechanism according to implementations of the present disclosure.
Figure 2:
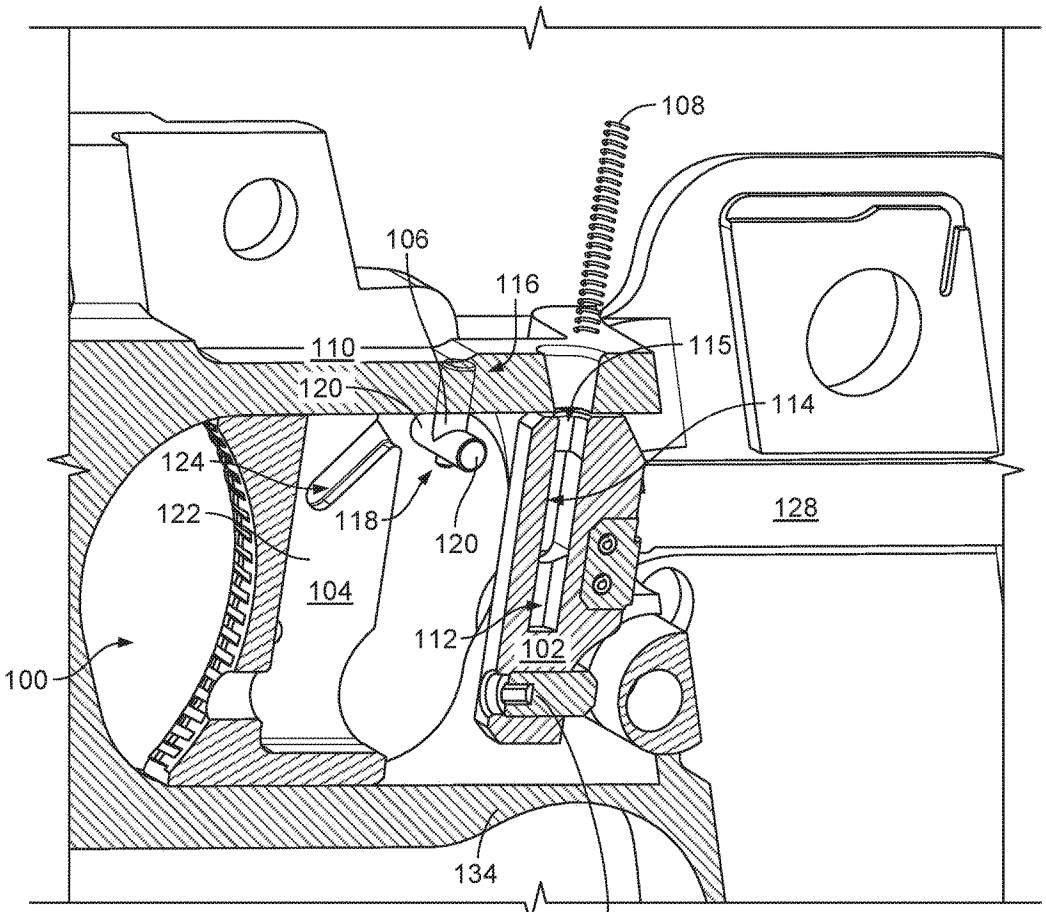
FIG. 2 depicts an exploded view of the trigger assembly and safety mechanism of FIG. 1.

FIG. 1 depicts a cutaway view of a representative trigger assembly 100 that includes an integrated safety mechanism, and FIG. 2 depicts an exploded view of the trigger assembly 100. Referring to both FIGS. 1 and 2, the trigger assembly 100 includes a trigger 102, a trigger cover 104, a pin 106, and a spring 108. Trigger assembly 100 is configured to be installed in a firearm frame 110.

Trigger 102 is connected to a trigger bar 128 which operates a fire control mechanism (e.g., a sear and hammer or a sear and striker) of the firearm 111 to discharge the firearm 111. Trigger 102 has a channel 112 formed within its body. Pin 106 and spring 108 are disposed within the channel 112 in trigger 102. One end 116 of pin 106 extends through an opening 115 at an end of channel 112. Pin 106 is sized such that a portion of one end 116 extends through the opening 115 in channel 112 and into a detent or hole 126 in frame 110. Spring 108 applies a force against the other end 118 of pin 106 to bias pin 106 towards hole 126. The engagement of end 116 of pin 106 within hole 126 prevents trigger 102 from moving, and thereby, preventing the firearm 111 from being discharged until pin 106 is disengaged from hole 126.

Pin 106 has a post 120 extending outward from end 118. When pin 106 is installed in channel 112 of trigger 102, post 120 extends out of a slot 114 formed on either side of trigger 102. Slots 114 provide access to channel 112. The edges of slots 114 may also aid in retaining pin 106 within channel 112. For example, post 120 may rest against the edge of slot 114. Pin 106 is configured to engage with detent or hole 126 in the firearm frame 110. Pin 106 prevents unintended movement of trigger 102 when engaged with hole 126.

Trigger cover 104 at least partially encloses trigger 102. A cam channel 124 is formed in an inner surface 122 of trigger cover 104. Cam channel 124 is configured to engage with post 120 of pin 106 when the trigger cover 104 is installed on trigger 102. Although only one inner surface 122 of trigger cover 104 is shown, trigger cover 104 can include cam channels 124 on inner surfaces 122 of both sides of trigger cover 104. Cam channel 124 forms an angle, θ, with the axis 130 of channel 112.

In the implementation of the trigger safety mechanism shown in FIG. 1, the trigger cover 104 serves as the safety deactuation device. Trigger cover 104 is configured to cause pin 106 to disengage from hole 126, thereby, permitting trigger 102 to move rearward and actuate the firearm's 111 fire control mechanism (not shown).

Trigger cover 104 is moveable relative to trigger 102. Cam channel 124 is configured such that when trigger cover 104 is moved relative to trigger 102 a force is applied to the post 120 of pin 106 in a direction opposite to the force applied by spring 108. Thus, when trigger cover 104 is moved relative to trigger 102 the engagement between cam channel 124 and post 120 causes pin 106 to retract into channel 112. Pin 106 retracts into channel 112 until end 116 of pin 106 disengages from hole 126. Once end 116 of pin 106 disengages from hole 126, trigger 102 is free to move so that the firearm's 111 fire control mechanism can be activated to discharge the firearm 111. The operation of trigger assembly 100 is discussed in more detail below with respect to FIGS. 6A-6D.

The angle, θ, of cam channel 124 can be more than 10 and less than 90 degrees. In some implementations, the angle, θ, of cam channel 124 can be between 35 and 55 degrees. In some implementations, the angle, θ, of cam channel 124 can be between 40 and 50 degrees. In some implementations, the angle, θ, of cam channel 124 is approximately 45 degrees.

In some implementations, trigger 102 includes an over-travel adjustment 132 such as a set screw. The over-travel adjustment 132 can be adjusted to minimize distance that trigger 102 is permitted to move after the firearm's 111 firing mechanism is released.

In some implementations, hole 126 may be formed below or to the side of the trigger assembly 100 instead of above the trigger assembly as shown in the figures. For example, hole 126 can be formed in trigger guard 134. In such an implementation, orientation of the trigger assembly components would be flipped, however, the operation of the trigger assembly 100 would be similar.

Figure 3:
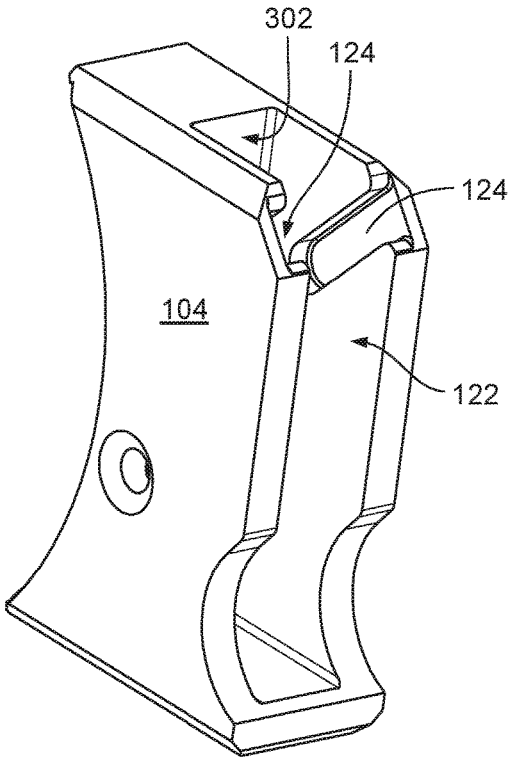
FIG. 3 depicts a perspective view of an example trigger cover according to implementations of the present disclosure.

FIG. 3 depicts a rear perspective view of an example trigger cover 104 according to implementations of the present disclosure. FIG. 3 more clearly illustrates the cam channels 124 on both sides of the trigger cover 104. In some implementations, trigger cover 104 has a cam channel 124 on only one side. Trigger cover 104 has an inner wall 302 which contacts with trigger 102 to discharge the firearm 111 as discussed in more detail below. In some implementations, trigger 102 can include texturing on a front surface, e.g., as shown more clearly in FIGS. 1 and 2.

Trigger cover 104 can be made from a metal, plastic or other suitable material. For example, in some implementations, trigger cover 104 is made from steel or aluminum. Trigger cover 104 can be made from a molding process such as metal injection molding or a plastic molding process. In some implementations, trigger cover 104 is made from a plastic (e.g., polymer) material such as polyamide nylon. Trigger cover 104 can be made from a plastic material that has a high glass content (e.g., a plastic with 50%-60% glass content) to, e.g., reduce the friction between the trigger cover 104 and other components. In some implementations, a plastic material having a high glass content may provide increased strength over other materials.

Figure 4:
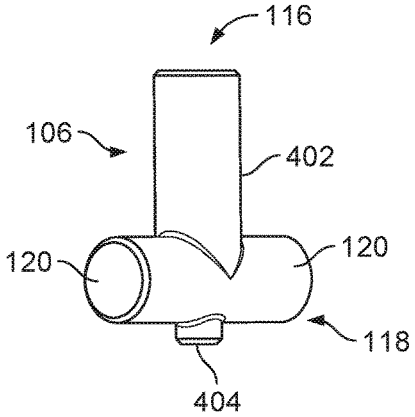
FIG. 4 depicts a perspective view of an example safety pin according to implementations of the present disclosure.

FIG. 4 depicts a perspective view of an example safety pin 106 according to implementations of the present disclosure. Pin 106 has is "T" shaped with posts 120 extending in opposite directions at end 118. Posts 120 are substantially perpendicular to the body 402 of pin 106. Pin 106 can have a lug 404 extending from end 118 to aid in aligning spring 108 with the end 118 of pin 106 when installed in trigger 102. In some implementations, pin 106 can have only one post 120 extending from end 118 (e.g., an "L" shape).

Pin 106 can be made from a metal, plastic or other suitable material. For example, in some implementations, pin 106 is made from steel or aluminum. Pin 106 can be made from a molding process such as metal injection molding or a plastic molding process. In some implementations, pin 106 is made from a plastic (e.g., polymer) material such as polyamide nylon. Pin 106 can be made from a plastic material that has a high glass content (e.g., a plastic with 50%-60% glass content) to, e.g., reduce the friction between the pin 106 and other components. In some implementations, a plastic material having a high glass content may provide increased strength over other materials.

Figure 5:
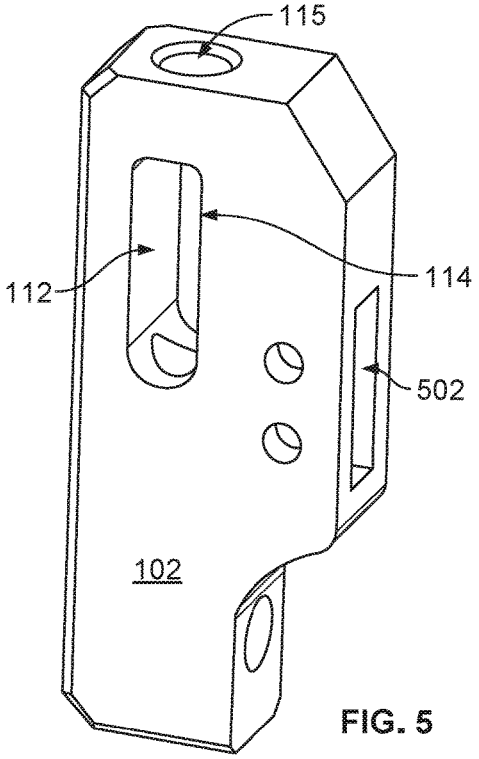
FIG. 5 depicts a perspective view of an example trigger according to implementations of the present disclosure.

FIG. 5 depicts a perspective view of an example trigger 102 according to implementations of the present disclosure. FIG. 5 more clearly illustrates slots 114 on both sides of channel 112 and opening 115 at the end of channel 112. Trigger 102 also includes an interface 502 for connecting to trigger bar 128. In some implementations, the trigger includes a slot 114 on only one side.

Trigger 102 can be made from a metal, plastic or other suitable material. For example, in some implementations, trigger 102 is made from steel or aluminum. Trigger 102 can be made from a molding process such as metal injection molding or a plastic molding process. In some implementations, trigger 102 is made from a plastic (e.g., polymer) material such as polyamide nylon. Trigger 102 can be made from a plastic material that has a high glass content (e.g., a plastic with 50%-60% glass content) to, e.g., reduce the friction between the trigger 102 and other components. In some implementations, a plastic material having a high glass content may provide increased strength over other materials.

Figure 6A:
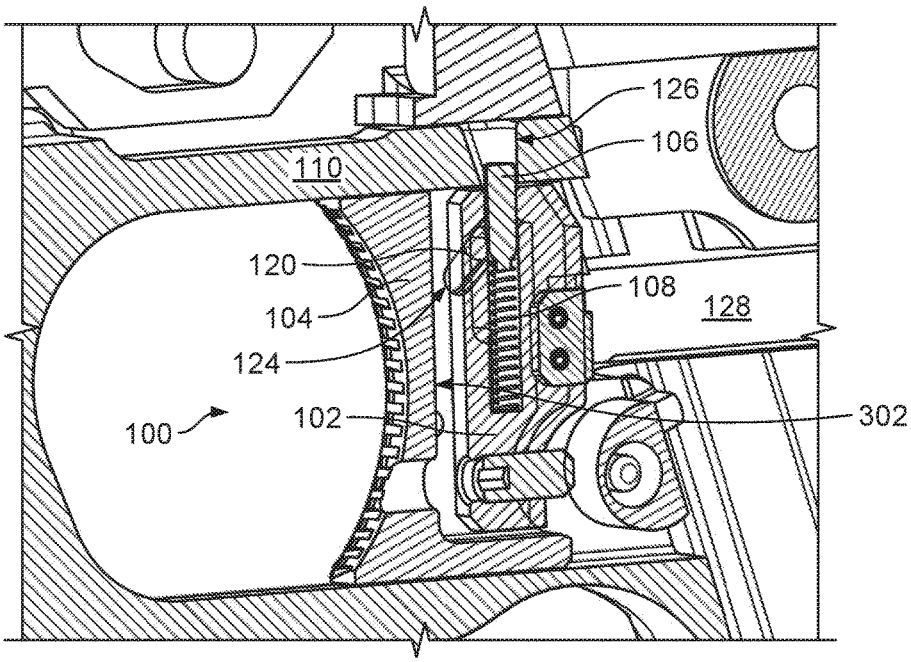
FIGS. 6A-6D depict a series of internal diagrams illustrating the operation of the of the trigger assembly and safety mechanism of FIG. 1.

FIGS. 6A-6D depict a series of internal diagrams illustrating the operation of the trigger assembly 100 and safety mechanism of FIG. 1. FIG. 6A shows the trigger assembly 100 and pin 106 in a first, safe, position. In the safe position, the inner wall 302 of trigger cover 104 is spaced apart from trigger 102. Pin 106 is biased into engagement with hole 126 in frame 110 by spring 108. In addition, the force of spring 108 may also operate to retain trigger cover 104 in a forward position with inner wall 302 separated from trigger 102 through the engagement of posts 120 and cam channels 124. In the safe position, the engagement between pin 106 and hole 126 prevents trigger 102 from moving, and thereby, preventing the firearm 111 from being discharged.

Figure 6B:
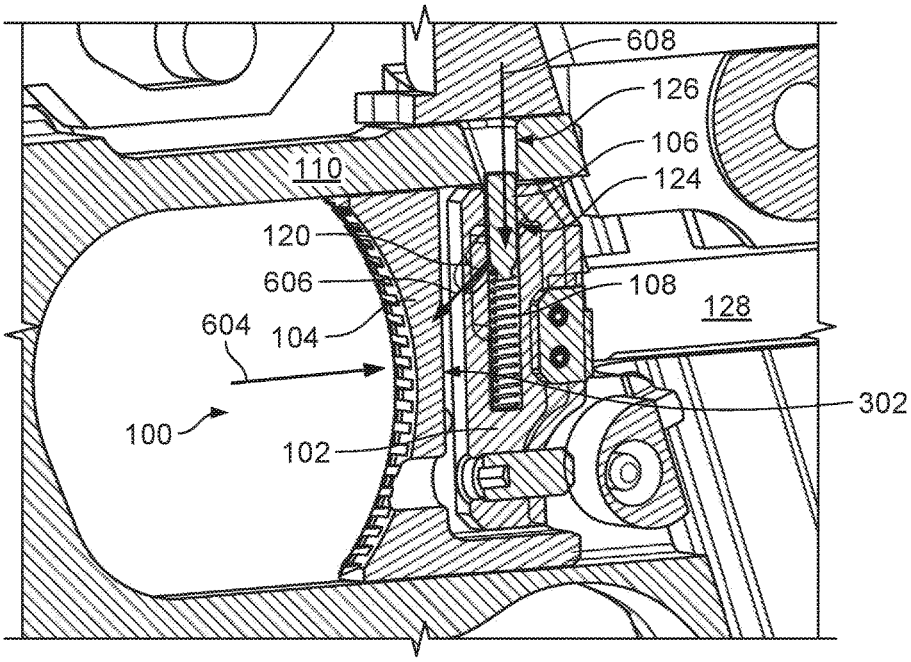

In FIG. 6B, a force is applied to the front surface of trigger cover 104 by a user (e.g., a user squeezing the trigger cover 104 to discharge the firearm 111), causing it to be moved towards trigger 102 in the direction of arrow 604. As trigger cover 104 is moved towards trigger 102, posts 120 slide within cam channels 124 (in the direction of arrow 606) causing pin 106 to move within channel 112 (in the direction of arrow 608) against the pressure of spring 108.

Figure 6C:
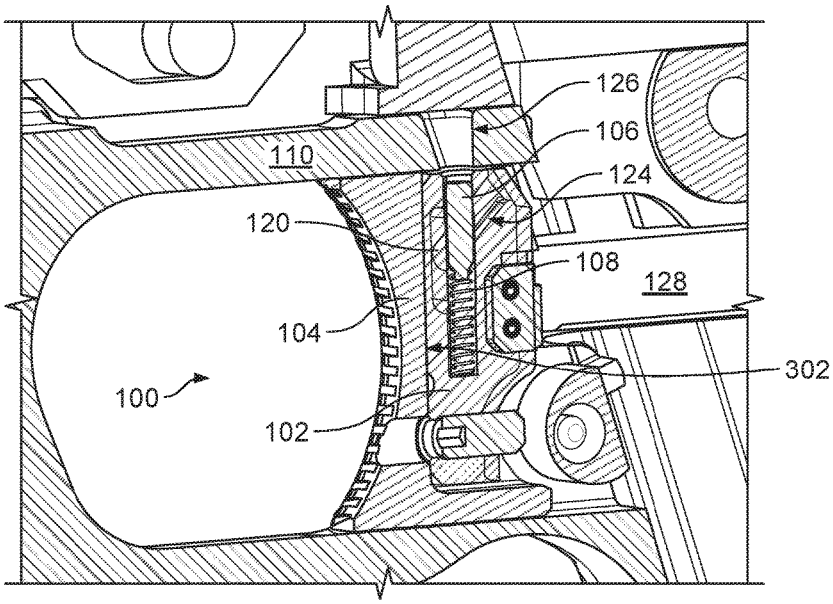

FIG. 6C shows the trigger assembly 100 and pin 106 in a second, fire, position. In FIG. 6C, trigger cover 104 is moved, under the user's force, into contact with trigger 102. More specifically, trigger cover 104 is moved such that inner wall 302 of trigger cover 104 is in contact with trigger 102. Posts 120 slide further along cam channels 124 causing pin 106 to be retracted further into channel 112 and disengage from hole 126 in frame 110. In the fire position, the pin 106 is disengaged from hole 126 which permits trigger 102 to move and activate the firearm's 111 fire control mechanism to discharge the firearm 111.

Figure 6D:
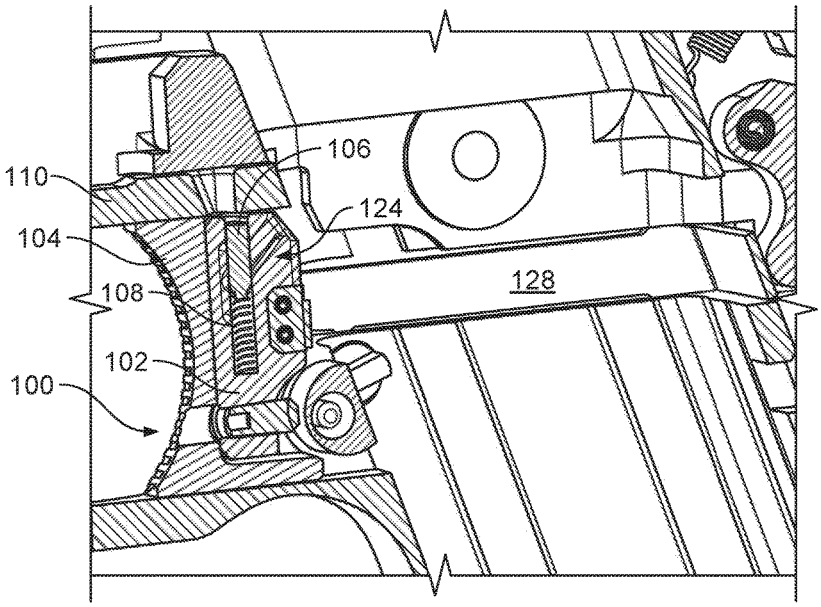

FIG. 6D shows the trigger assembly 100 moved fully rearward to activate the fire control mechanism and discharge the firearm 111. When the user applied force is released from the trigger cover 104, springs in the fire control mechanism resets trigger 102 to the position shown in FIG. 6A, and spring 108 resets pin 106 and trigger cover 104 to the safe position, as shown in FIG. 6A.

Although the trigger assembly 100 is illustrated as a straight-pull trigger design, the trigger assembly 100 can be implemented as a hinged trigger. The components of the trigger assembly 100 can be configured for use in a hinged trigger. For example, the angle of cam channels 124 can be altered to permit a trigger cover 104 to retract pin 106 by a pivoting motion of the trigger cover 104. As another example, the cam channels 124 may be formed in an arcing shape to accommodate the pivoting motion of a hinged trigger.

In some implementations, the trigger assembly 100 can be arranged such that pin 104 engages with a hole or detent below the trigger 102 in the trigger guard of a firearm. For example, the trigger 102, pin 106, and cam channels 124 on the trigger cover 104 can be inverted from the configuration shown in FIGS. 1 and 2.

FIG. 7 depicts a cutaway view of another implementation of a trigger assembly 700 and safety mechanism according to the present disclosure. Trigger assembly 700 is similar in structure and operation to that of trigger assembly 100. However, trigger assembly 700 differs from trigger assembly 100 (shown in FIGS. 1 and 2) by replacing the cam channels 124 in trigger cover 104 by a lever 702. Lever 702 is pivotally coupled to trigger 102. Lever 702 is positioned to transfer a user applied force from trigger cover 104 to post 120 on pin 106. For example, as a user applies a force on the front surface of trigger cover 104 (in the direction of arrow 704) the inner wall 302 of trigger cover 104 moves a first end of lever 702 in the direction of arrow 706, thereby, pivoting lever 702 clockwise (e.g., as shown by arrow 708). A second, opposite, end of lever 702 provides a downward force (in the direction of arrow 710) to safety pin 106 to disengage the pin 106 from a corresponding hole or detent in a firearm frame (or trigger guard). The combination of trigger cover 104 and lever 702 of trigger assembly 700 servers as a safety deactuation device.

Lever 702 can be made from a metal, plastic or other suitable material. For example, in some implementations, lever 702 is made from steel or aluminum. Lever 702 can be made from a molding process such as metal injection molding or a plastic molding process. In some implementations, lever 702 is made from a plastic (e.g., polymer) material such as polyamide nylon. Lever 702 can be made from a plastic material that has a high glass content (e.g., a plastic with 50%-60% glass content) to, e.g., reduce the friction between the lever 702 and other components. In some implementations, a plastic material having a high glass content may provide increased strength over other materials.

FIG. 8A depicts a cutaway view of another implementation of a trigger assembly 800 and safety mechanism according to the present disclosure. FIG. 8B depicts a front view of the trigger assembly 800 and safety mechanism of FIG. 8A. With reference to FIGS. 8A and 8B, trigger assembly 800 is similar in operation to trigger assembly 100, but differs slightly in structure. Trigger assembly 800 includes a trigger 802, safety pin 806, and a trigger insert 804. Trigger 802 and safety pin 806 are similar to trigger 102 and safety pin 106 of trigger assembly 100, respectively. Trigger insert 804 replaces trigger cover 104. Trigger insert 804 engages with pin 806 to disengage pin 806 from a detent or hole in a firearm frame or trigger guard. Trigger insert 804 includes a beveled surface 808*a* with engages with a corresponding beveled surface 808*b* of pin 806. When trigger insert 804 is moved rearward relative to trigger 804 (in the direction of arrow 810) the angle of the beveled surfaces 808*a*/808*b* applies a downward force to pin 806 (arrow 812). Pin 806 is moved downward against the pressure of spring 108. Similar to trigger assemblies 100 and 700, the trigger insert 804 of trigger assembly 800 servers as a safety deactuation device.

Trigger insert 804 can be made from a metal, plastic or other suitable material. For example, in some implementations, trigger insert 804 is made from steel or aluminum. Trigger insert 804 can be made from a molding process such as metal injection molding or a plastic molding process. In some implementations, trigger insert 804 is made from a plastic (e.g., polymer) material such as polyamide nylon. Trigger insert 804 can be made from a plastic material that has a high glass content (e.g., a plastic with 50%-60% glass content) to, e.g., reduce the friction between the trigger insert 804 and other components. In some implementations, a plastic material having a high glass content may provide increased strength over other materials.

Although the trigger assembly and safety mechanism have been described above in reference to an implementation for use in a semiautomatic handgun, in some implementations the trigger assembly and safety mechanism can be incorporated into or configured for use in other firearm designs. For example, the trigger assembly and safety mechanism can be configured for use in automatic, semiautomatic, or non-semiautomatic pistols, revolvers, rifles, and shotguns. Additionally, a similar trigger assembly and safety mechanism can be configured for use in a frame, receiver, or stock of a corresponding firearm (e.g., a rifle or shotgun).

For clarity, the term "frame" as used herein refers to any component of a firearm in which a trigger assembly can be installed depending on the type or style of firearm. For example, while firearm styles vary and firearm triggers can be installed in various firearm components such as in a frame (as is often the case in handguns), in a receiver (as is common in rifles and shotguns), in a grip or stock, or in a separate trigger housing, the implementations of the trigger assembly of the present disclosure can be adapted for installation in any such firearm components.

As used herein, the term "semiautomatic firearm" refers to a firearm which automatically extracts a spent cartridge casing and chambers a new round after each shot. The semiautomatic firearm uses a portion of the energy from a firing round to extract a spent cartridge casing from the fired round, cock the firearm, and chamber a new round with each pull of the trigger, but requires a separate pull of the trigger to discharge the new round.

As used herein, the term "non-semiautomatic firearm" refers to a firearm which requires a user to manually manipulate some mechanism of the firearm to chamber a new round after each shot.

As used herein, the term "automatic firearm" refers to a firearm which automatically extracts a spent cartridge casing, chambers a new round after each shot, and fires the new round in a repeating fashion with a single pull of the trigger. In an automatic firearm, this process repeats until the trigger is released or all of the ammunition in the firearm is expended.

As used herein, the terms "orthogonal" or "substantially orthogonal" refer to a relation between two elements (e.g., lines, axes, planes, surfaces, or components) that forms a ninety degree (perpendicular) angle within acceptable engineering, machining, or measurement tolerances. For example, two surfaces can be considered orthogonal to each other if the angle between the surfaces is within an acceptable tolerance of ninety degrees (e.g., ±1-2 degrees).

As used herein, the terms "aligned," "substantially aligned," "parallel," or "substantially parallel" refer to a relation between two elements (e.g., lines, axes, planes, surfaces, or components) as being oriented generally along the same direction within acceptable engineering, machining, drawing measurement, or part size tolerances such that the elements do not intersect or intersect at a minimal angle. For example, two surfaces can be considered aligned with each other if surfaces extend along the same general direction of a device.

As used herein, terms describing relative directions or orientations (e.g., front, back/rear, top/upper, bottom/lower, left/right) of various elements are used in reference to the perspective of a user holding a firearm. Thus, for example, the front edge or surface of a component refers to that edge or surface of the component that is nearest or facing the muzzle of the firearm when the component is properly installed in the firearm. Similarly, for example, the back edge or surface of a component refers to that edge or surface of the component that is farthest from or facing away from the muzzle of the firearm when the component is properly installed in the firearm. Likewise, for example, the top/upper edge or surface of a component refers to that edge or surface of the component that is nearest or facing the top of the firearm when the component is properly installed in the firearm and the firearm is held in a normal firing position. Furthermore, for example, the bottom/lower edge or surface of a component refers to that edge or surface of the component that is nearest or facing the bottom of the firearm when the component is properly installed in the firearm and the firearm is held in a normal firing position. Finally, for example, the right/left edge or surface of a component refers to that edge or surface of the component that is nearest or facing the right/left side of the firearm from the perspective of a user when the component is properly installed in the firearm and the firearm is held in a normal firing position.

While a number of examples have been described for illustration purposes, the foregoing description is not intended to limit the scope of the invention, which is defined by the scope of the appended claims. There are and will be other examples and modifications within the scope of the following claims.

What is claimed is:

1. A firearm safety device comprising:

a trigger comprising a channel therein with an opening at an end of the channel;

a pin disposed within the channel such that a portion of the pin extends through the opening; and a cover at least partially enclosing the trigger and configured to move relative to the trigger, the cover comprising a cam channel configured to engage with the pin and move the pin within the channel of the trigger as the cover moves relative to the trigger.

2. The device of claim 1, wherein the pin is sized such that the portion of the pin can extend through the opening to engage with a hole in a firearm frame.

3. The device of claim 1, further comprising a spring disposed within the channel of the trigger.

4. The device of claim 1, wherein the pin is "T" shaped.

5. The device of claim 1, wherein the pin comprises at least one post extending substantially perpendicular to an axis of the pin, the post configured to engage the cam channel in the cover.

6. The device of claim 1, wherein the trigger is a straight-pull trigger.

7. The device of claim 1, further comprising a trigger bar coupled to the trigger.

8. The device of claim 1, wherein an angle between the cam channel and an axis of the channel in the trigger is more than 10 and less than 90 degrees.

9. The device of claim 1, wherein an angle between the cam channel and an axis of the channel in the trigger is between 35 and 55 degrees.

10. A firearm comprising:

a frame; and a trigger assembly installed within the frame, the trigger assembly comprising:

a trigger comprising a channel therein with an opening at an end of the channel;

a pin disposed within the channel such that a portion of the pin extends through the opening and into a hole in the frame, when the pin is in a first position; and a safety deactuation device configured to engage with the pin and move the pin into a second position within the channel of the trigger as the safety deactuation device is moved relative to the trigger, wherein the safety deactuation device comprises a cover at least partially enclosing the trigger and configured to move relative to the trigger.

11. The firearm of claim 10, wherein, when the pin is in the first position, the pin prevents the trigger from moving.

12. The firearm of claim 10, wherein, when the pin is in the second position, the trigger is free to move.

13. The firearm of claim 10, further comprising a spring disposed within the channel of the trigger.

14. The firearm of claim 10, wherein the cover comprises a cam channel configured to engage with the pin and move the pin within the channel of the trigger as the cover moves relative to the trigger.

15. The firearm of claim 10, wherein the pin comprises at least one post extending substantially perpendicular to an axis of the pin, the post configured to engage a cam channel in the cover.

16. The firearm of claim 15, wherein an angle between the cam channel and an axis of the channel in the trigger is between 40 and 50 degrees.

17. A firearm safety device comprising:

a trigger comprising a channel therein with an opening at an end of the channel;

a pin disposed within the channel such that a portion of the pin extends through the opening; and a safety deactuation device configured to engage with the pin and move the pin within the channel of the trigger as the safety deactuation device is moved relative to the trigger, wherein the safety deactuation device comprises a cover at least partially enclosing the trigger and configured to move relative to the trigger.

18. The device of claim 17, wherein the cover comprises a cam channel configured to engage with the pin and move the pin within the channel of the trigger as the cover moves relative to the trigger.

* * * * *